United States Patent [19]

Herstein

[11] Patent Number: 4,810,981

[45] Date of Patent: Mar. 7, 1989

[54] ASSEMBLY OF MICROWAVE COMPONENTS

[75] Inventor: Dov Herstein, Great Neck, N.Y.

[73] Assignee: General Microwave Corporation, Amityville, N.Y.

[21] Appl. No.: 58,017

[22] Filed: Jun. 4, 1987

[51] Int. Cl.[4] ..... H01P 5/00

[52] U.S. Cl. ..... 333/27; 333/33; 333/238; 333/260

[58] Field of Search ..... 333/21 R, 26, 33, 34, 333/245, 246, 238, 260, 27; 439/581, 507; 361/412

[56] References Cited

U.S. PATENT DOCUMENTS

| | | | |
|---|---|---|---|
| 2,721,312 | 10/1955 | Grieg et al. | 333/238 |
| 3,218,585 | 11/1965 | May | 333/246 |
| 3,325,752 | 6/1967 | Barker | 333/260 X |
| 3,539,966 | 11/1970 | Logan | 333/260 X |
| 3,806,767 | 4/1974 | Lehrfeld | 333/260 X |
| 3,825,861 | 7/1974 | O'Donnell | 333/260 X |

*Primary Examiner*—Paul Gensler

*Attorney, Agent, or Firm*—Morton C. Jacobs; William Freedman

[57] ABSTRACT

This microwave assembly comprises a pair of microwave components and a stripline connecting device interconnecting the components. Each of the components comprises a conductive carrier defining a ground plane, dielectric material on the conductive carrier, and a conductor on the dielectric material having a projecting end portion. The stripline connecting device comprises: (a) a central conductor having conductive terminal portions at opposite ends thereof for respectively contacting the projecting end portions of the conductors of the microwave components, (b) two sections of dielectric material respectively located at opposite sides of the central conductor, and (c) two housing portions of conductive material defining a ground plane for the connecting device and located at opposite sides of the dielectric sections. The connecting device further includes fastening devices for clamping the housing portions together, with the dielectric sections sandwiched between the housing portions and with the terminal portions of the central conductor and the projecting end portions of the conductors of the microwave components sandwiched between the dielectric sections.

26 Claims, 4 Drawing Sheets

ASSEMBLY OF MICROWAVE COMPONENTS

BACKGROUND

This invention relates to a microwave assembly comprising microwave components and a stripline-type connecting device for electrically interconnecting these components.

As used in this patent application, the term "component" comprehends both active and passive components and an assembly or sub-assembly of components as well as connectors; and the term "stripline," as applied to a connecting device, denotes a connecting device that comprises a conductor, two metal parts spaced from the conductor and located on opposite sides of the conductor, and solid dielectric interposed between the metal parts and the conductor.

One technique that often has been used for interconnecting, or integrating, microwave components has involved equipping the components with coaxial type connectors (e.g., SMA or the equivalent) and interconnecting these connectors by using mating connectors and some form of coaxial cable connected between the mating connectors. The radio frequency (RF) performance of such an assembly is very good, but this technique is relatively expensive and results in an inefficient use of assembly volume.

Another prior technique involves the use of connectorless (or drop-in) components. These components come in many different forms, the most common of which are those with coaxial terminal structures including a central conductor with a projecting end portion, and those of microstrip form, where a conductive strip mounted on an insulating substrate terminates at one end in a tab-type end portion. Drop-in components are usually integrated into an assembly by soldering or welding the above-described end portions to a microstrip transmission line "motherboard". Typically, this microstrip transmission line motherboard comprises a metal plate defining a ground plane, a dielectric substrate bonded to the metal plate, and a strip conductor bonded to the exposed surface of the substrate.

Typically, the individual components of this latter type assembly and a prototype form of the assembly are evaluated prior to integration either in a coaxial test fixture using removable connectors (for the coaxial-type drop-in components) or in a microstrip-coaxial test fixture (for the microstrip drop-in components).

Although the above-described prior microstrip integration technique has the advantage of reduced assembly volume and weight as compared to the first technique, it has some serious disadvantages. Some of these are: (1) RF performance of the integrated assembly is degraded due to ground discontinuities and RF leakage (e.g., between two parts of a single device or between adjacent lines of two or more devices), (2) as a result, the correlation between the RF performance of the "prototype" and the "integrated" versions of the assembly is typically poor, (3) insertion losses may be relatively high, and (4) the integrated assembly does not lend itself to easy replacement of components since the terminals of the components are welded or soldered to the microstrip transmission line motherboard.

OBJECTS

An object of my invention is to provide microwave-assembly integrating means that (i) is relatively inexpensive and compact compared to that resulting from the first of the above-described techniques and (ii) has a relatively high degree of freedom from the disadvantages of the immediately-preceding paragraph.

Another object is to provide inexpensive and compact microwave-assembly integrating means having reduced RF leakage problems and reduced ground discontinuity problems compared to those typically associated with the prior microstrip integrating means described hereinabove.

Another object is to provide compact and inexpensive microwave-assembly integrating means having high quality RF performance and exhibiting good correlation between evaluated RF specifications and actual RF performance of components following final integration in the assembly.

Another object is to provide microwave-assembly integrating means in which the components and the assembly can be readily evaluated when the assembly is in its prospective finally-integrated form and, if deficient, selected components can be easily replaced to allow for renewed evaluation.

Still another object is to provide, in a microwave assembly that comprises a stripline-type connecting device and another device not of the coaxial terminal type, excellent ground continuity approaching that available in those assemblies in which said other device is of the coaxial terminal type.

SUMMARY

In carrying out my invention in one form, I provide an assembly comprising a pair of microwave components and a stripline connecting device interconnecting the components. Each of said components comprises conductive structure defining a ground plane, dielectric material on the conductive structure, and a conductor on the dielectric material having a projecting end portion. The stripline connecting device comprises: (a) elongated interconnecting structure having conductive terminal portions at opposite ends thereof for respectively contacting the projecting end portions of the conductors of the microwave components, (b) two sections of dielectric material respectively located at opposite sides of the interconnecting structure, and (c) two housing portions of conductive material defining a ground plane for the connecting device, located at opposite sides of the dielectric sections, and respectively containing channels in which the dielectric sections are located. The connecting device further includes means for clamping the housing portions together, with the dielectric sections sandwiched between the housing portions and with the interconnecting structure and the projecting end portions of the conductors of the microwave components sandwiched between the dielectric sections.

BRIEF DESCRIPTION OF DRAWINGS

For a better understanding of the invention; reference may be had to following detailed description taken in connection with the accompanying drawings, wherein.

DETAILED DESCRIPTION OF PREFERRED EMBODIMENTS

Figure 1:
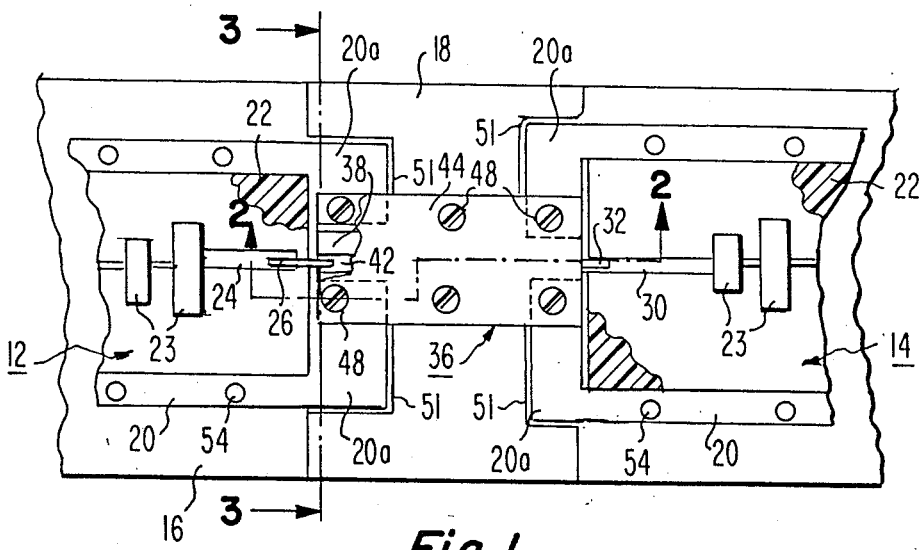
FIG. 1 is a plan view, partly in section, showing a microwave assembly embodying one form of the invention.
Figure 2:
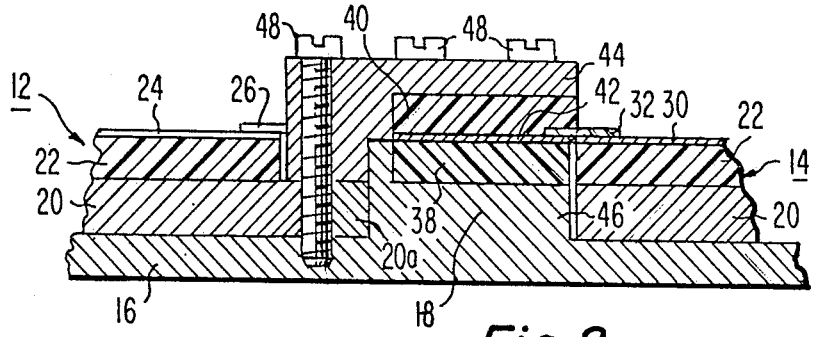
FIG. 2 is a sectional view along the line 2—2 of FIG. 1.
Figure 3:
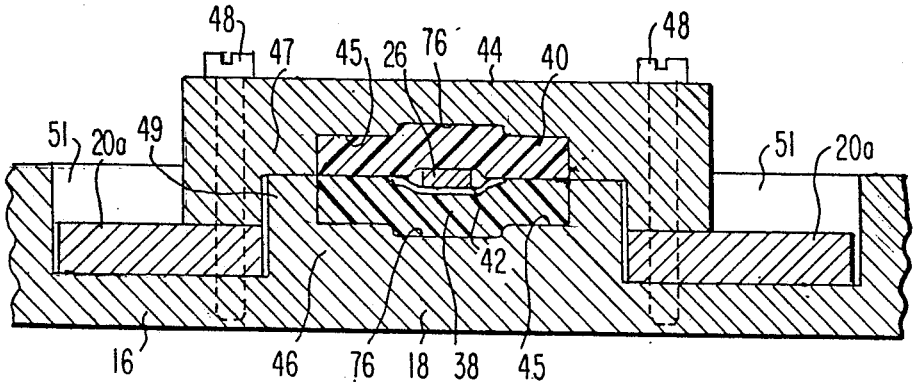
FIG. 3 is an enlarged sectional view along the line 3—3 of FIG. 1.

The Embodiment of FIGS. 1–3

Referring now to FIGS. 1 and 2, the microwave assembly illustrated therein comprises two drop-in type microstrip circuit components 12 and 14 that are mounted on a metal floor 16. The metal floor 16 includes an embossment 18 that forms a wall extending between the two circuit components. Each circuit component comprises a metal carrier 20 in plate form, a substrate 22 of dielectric material bonded to the upper surface of the carrier, and circuit elements 23 bonded (e.g., by adhesive, or through printing, deposition and etching or other conventional means) to the upper surface of the substrate. The circuit elements of component 12 include a microstrip conductor 24, to which is attached (e.g., by soldering, welding, or conductive adhesive) a terminal end portion in the form of a tab 26 projecting beyond the right-hand end surface of the dielectric substrate. The circuit elements of component 14 similarly include a microstrip conductor 30 to which is attached by soldering, welding, or conductive adhesive a tab 32 extending beyond the left-hand end of the dielectric substrate of component 14. While the illustrated tabs are of rectangular cross-section, they could be of other suitable cross-section, such as round or oval.

For interconnecting, or integrating, the microwave circuit components 12 and 14, I provide a stripline-type connecting device 36. This connecting device comprises two juxtaposed sections 38 and 40 of dielectric material, preferably a soft and resilient dielectric material such as polytetrafluoroethylene, either plain or glass reinforced. Such materials are available under the trademarks Teflon and Duroid. On the upper surface of the lower dielectric section 38, there is a printed, or otherwise deposited, center conductor 42 in strip form that extends along substantial the entire length of section 38. When the upper section 40 is in its position of FIG. 2, conductor 42 is located between confronting faces of the two dielectric sections 38 and 40.

The connecting device 36 further comprises two metal housing portions, or plates, 44 and 46, located at opposite sides of the dielectric sections 38 and 40. Upper housing portion 44 is a discrete member, whereas lower housing portion 46 is formed by the wall 18 of the metal floor 16. As best seen in FIG. 3, each of the housing portions 44 and 46 contains a channel 45 facing the other housing portion for receiving one of the dielectric sections 38 or 40 and for providing sidewalls, or flanges, at the lateral edges of each dielectric section projecting from the bottom of the channel toward the other housing portion. The sidewalls in the upper housing portion are designated 47, and those in the lower housing portions are designated 49. In the illustrated embodiment, the channels 45 are in alignment with each other. My invention, in its broader aspects, comprehends an arrangement in which these channels are out of alignment but still overlap, as shown, in the region where the conductor 42 is located.

The upper housing portion 44 is clamped to the lower housing portion by a plurality of metal screws 48 disposed at spaced locations along opposite lateral edges of the housing portion 44. Each of these screws fits through a hole in the upper housing portion into an aligned tapped hole in the lower housing portion, so that when the screw is tightened, it forces the upper housing portion downward toward the lower housing portion. Preferably, the screws 48 are tightened until the lower surfaces, or free ends, of flanges 47 on the upper housing portion contact the lower housing portion and the dielectric sections clamp together the conductor 42 and tabs 26 and 32.

The metal carriers 20 of the two circuit components 12 and 14 are attached to the grounded floor 16 by suitable screws inserted through holes 54 in the carriers that register with threaded holes in the floor, thus providing a good electrical contact between the carriers 20 and the connected floor 16 and enabling the carriers 20 to serve as ground planes for their circuit components. The tightened metal screws 48 of the connecting device 36 ensure a good electrical contact between the upper housing portion 44 and the lower housing portion 46, in effect, the grounded floor, thus enabling the two housing portions 44 and 46 to serve as a ground plane wrapped around the central conductor 42.

To improve ground continuity in the important junction regions at each end of the connecting device 36, the lower housing portion 46 of the connecting device at each of its ends is provided with two recesses 51 for respectively receiving conductive extensions 20*a* of the conductive carrier 20 of the adjacent microstrip component. As shown in FIGS. 2 and 3, these extensions 20*a* fit between the upper housing portion 44 and the lower housing portion 46 and have holes aligned with the adjacent holes in the two housing portions for respectively receiving two of the clamping screws 48. When the screws 48 are tightened, they clamp the carrier extensions 20*a* between the upper and lower housing portions 44 and 46, thus providing good metal-to-metal contact between the upper face of the carrier extension 20*a* and upper housing portion 44 and between the lower face of the carrier extension 20*a* and the lower housing portion. By providing good contact between these conductive elements that form the ground plane in the region immediately adjacent the junction between the transmission line conductors 24 and 42, I am able to provide excellent ground continuity in this important region.

The assembly of FIGS. 1–3 is made up in the following manner, starting with the circuit components 12 and 14 completed and suitably evaluated but not yet in place on the metal floor 16 and with the connecting device 36 not yet assembled The lower dielectric section 38 of the connecting device 36 is first inserted into the lower channel 45 (FIG. 3). Then the circuit components 12 and 14 are placed on the floor 16 in their positions illustrated in FIGS. 1 and 2, with their tab-type end portions 26 and 32 located atop the then-exposed central conductor 42 of connecting device 36. Then, the upper dielectric section 40 is placed within the channel 45 in the upper housing portion 44, and the upper housing portion 44 is placed atop the upper dielectric section with the channels 45 in the two housing portions in registry Then the screws 48 are inserted and tightened, thus sandwiching the two dielectric sections 38 and 40 between the two housing portions 44 and 46 and sandwiching the tabs 26 and 32 and the central conductor 42 between the dielectric sections, thereby establishing good contact between the tabs and the central conductor 42. A feature contributing to this good electrical contact is that the tabs 26 and 32 extend into the stripline connecting device 36 in overlapping relationship with the housing portions 44 and 46 so that clamping forces on the housing portions are transmitted directly to the tabs and the central conductor 42. The tabs, it will be noted, are in contact with a lateral face of the respective terminal portions of the central conductor 42.

When the central conductor 42 is engaged by the tabs 26 and 32 during the above-described clamping action, engagement occurs on the lateral faces of the terminal portions of the central conductor, also the lower dielectric section 38 and the printed conductor 42 thereon are deformed slightly by the downward force on the tab, developing the slightly grooved cross-sectional configuration shown in FIG. 3. Should the parts be unclamped later on, the dielectric section 38, being resilient, will revert at least partially to its original configuration; i.e., with a generally planar outer surface. The conductor 42, being printed or otherwise deposited on the lower dielectric section 38, is free to change its shape with the dielectric section 38 during such clamping and unclamping. The upper dielectric section 40 is also free to develop a slight groove on its lower surface to accommodate the tab 26 or 32 in response to clamping. The upper dielectric section reverts at least partially to its original ungrooved form when unclamped.

Figure 4:
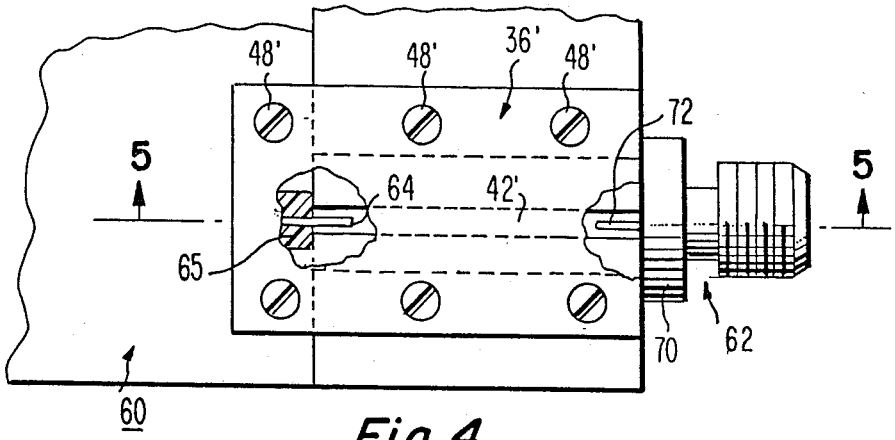
FIG. 4 is a plan view, partly in section, showing a microwave assembly embodying another form of the invention.
Figure 5:
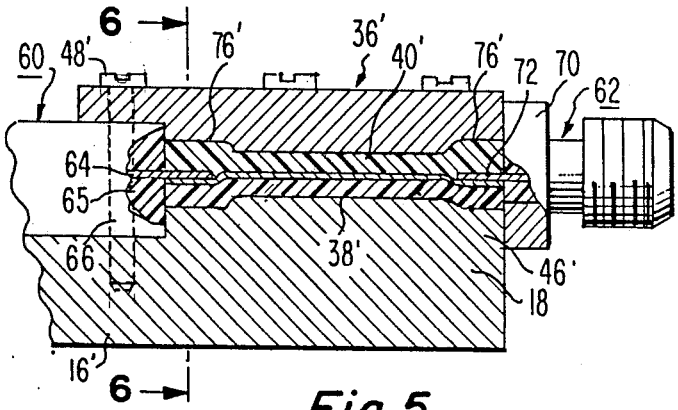
FIG. 5 is a sectional view along the line 5—5 of FIG. 4.
Figure 6:
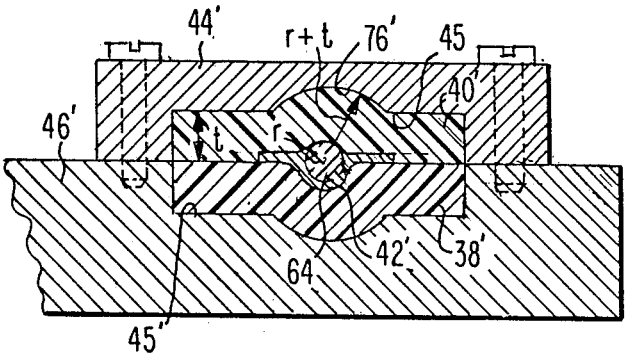
FIG. 6 is an enlarged sectional view along the line 6—6 of FIG. 5.

The Embodiment of FIGS. 4–6

Referring next to the embodiment of FIGS. 4–6, the assembly illustrated therein comprises a microwave circuit component 60 having coaxial terminal structure that is interconnected with a conventional coaxial connector 62 through a connecting device 36' corresponding to the similarly-designated connecting device of FIGS. 1–3.

The circuit component 60 has conventional coaxial terminal structure comprising an elongated lead 64 of round cross-section and grounded metal structure 66 of tubular cylindrical form surrounding the lead 64, spaced therefrom, and disposed coaxially therewith. Dielectric 65 is interposed between lead 64 and surrounding structure 66. As seen in FIGS. 4–6, the lead 64 projects to the right beyond the end of the surrounding grounded structure 66.

The illustrated connector 62 is a conventional coaxial connector of the SMA or similar type. As such, it comprises grounded tubular structure 70 and an elongated lead 72 of round cross-section spaced from and coaxial of the tubular structure 70. Dielectric 71 is interposed between lead 72 and tubular structure 70. Lead 72 projects to the left beyond the left-hand end of tubular structure 70.

The connecting device 36' of FIGS. 4–6 is very similar to the device 36 of FIGS. 1–3, and corresponding parts of the two devices have been designated with the same reference numerals but with addition of a prime (') in FIGS. 4–6. The connecting device of FIGS. 4–6, however, instead of interconnecting flat tabs, interconnects the round leads 64 and 72 of the two coaxial terminal structures. As shown in FIG. 6, the round lead 64 is positioned atop the printed conductor 42' and forces the conductor 42' to develop an approximately semi-circular furrow when the housing portions 44' and 46' are clamped together to sandwich the lead 64 and the conductor 42' between the dielectric sections 38' and 40'.

It is to be noted that the housing portions 44' and 46' of FIGS. 5 and 6 have a rounded recess 76' in the bottom, or inner, surface of each of the channels 45' in the end regions of the channels where a round lead 64 or 72 is received. As indicated in FIG. 6, this recess 76' has a radius of curvature substantially equal to the thickness t of the substrate plus the radius r of the lead. As a result, when the housing portions 44' and 46' are clamped together to deform the dielectric substrate material around the lead 64 or 72, the thickness of each dielectric section remains substantially the same across the width recess of the dielectric section. As shown in FIG. 5, the 76' terminates just beyond the end of the lead 64 or 72 in order to maintain at all locations along the length of the dielectric sections 38' and 40' substantially uniform thickness of each dielectric section across the width of the dielectric section. Avoiding changes in thickness of the dielectric substrate reduces RF perturbations that would otherwise result from such thickness changes.

In the embodiment of FIGS. 4–6, the upper housing overlaps the metal housing of component 60 and is clamped thereto in contacting engagement therewith by screws 48' located closely adjacent the junction between transmission line conductors 64 and 42'. This overlapping clamped construction closely adjacent the transmission line part 64, 42' contributes to good ground continuity in the ground plane structure constituted by elements 66, 44', 46'.

It should be noted that in the embodiment of FIGS. 1–3, a recess 76 corresponding to the recess 76' of FIGS. 5 and 6 is provided in the inner surface of each channel 45. This recess is of approximately the same configuration as the adjacent half of the tab 26 and serves also to maintain at all locations along the length of the dielectric sections 38 and 40 a substantially uniform thickness of the dielectric section across the width of the dielectric section, thereby reducing RF perturbations that would otherwise result from thickness changes.

General Features

It is noted that with each of the embodiments described hereinabove, RF connection between the components is achieved by mechanical clamping. Neither cement nor solder is required for the connection. Component removal and exchange can be performed simply by unclamping and reclamping the housing portions, and this can be done without damage to the leads or tabs. Thermal cycling tests from —55° C. to 125° C. have shown stable performance with these illustrated arrangements. Should the dielectric show evidence of "cold flow," the dielectric sections 38 and 40 or 38' and 40' can be easily replaced.

If necessary in a particular application, the components, output leads can be soldered, or attached by conductive adhesive, to the center conductor 42 or 42' at the final stage of integration. Thereafter, when replacing a component, the dielectric sections 38 and 40 or 38' and 40' can be replaced.

The illustrated arrangements have displayed very good electrical performance, including low insertion loss, low VSWR (voltage standing wave ratio), and high isolation with respect to adjacent lines.

Figure 10:
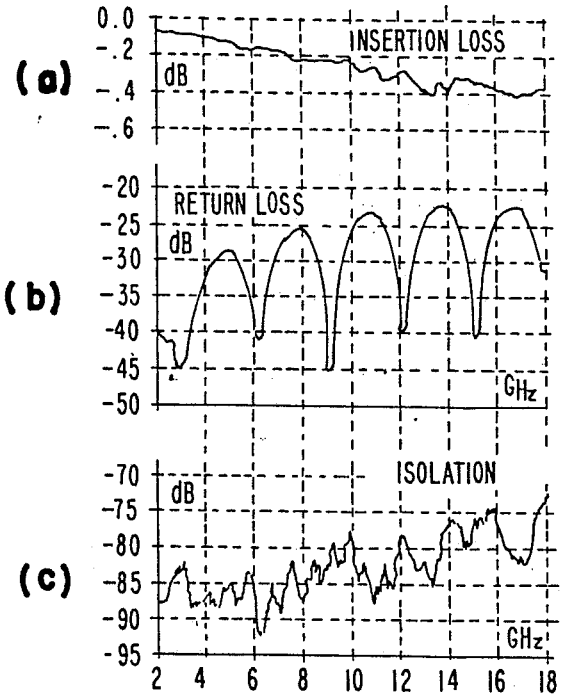
FIG. 10 comprises three graphic representations of the electrical performance of assemblies embodying the invention.

The graphic representations of FIG. 10 are illustrative of this very good electrical performance, showing in FIG. 10(*a*) insertion losses in dB plotted against the frequency in GHz of the microwave being transmitted and showing in FIG. 10(*b*) return losses in dB plotted against this frequency. These results were obtained using an assembly comprising two SMA connectors interconnected by a connecting device of the type shown having a one-inch length. The SMA connectors were TEK-WAVE 10-2005-0000 connectors. The frequency range was 2–18 GHz.

FIG. 10(*c*) illustrates the isolation performance of two ½-inch long parallel assemblies of the type referred to in the immediately-preceding paragraph separated by a thin conducting wall of 2 mm.

In the higher frequency range of 18 to 40 GHz, most prior networks and components are based upon microstrip transmission lines, printed on soft, low dielectric constant substrates. Outputs are either specialized coaxial connectors (K2 connectors, for example) or waveguides. My coupling technique works with both, as will be apparent from the embodiment of FIGS. 4–6 and that of FIG. 7, to be described. Using an assembly comprising a one-inch long connecting device of the type herein illustrated and a pair of K connectors clamped thereto at its opposite ends, evaluations were made at frequencies up to 40 GHz. Insertion loss was better than 0.9 dB and return loss better than 13 dB (at 40 GHz). The same clamping technique was used in this assembly as that used for the lower frequency range.

Figure 7:
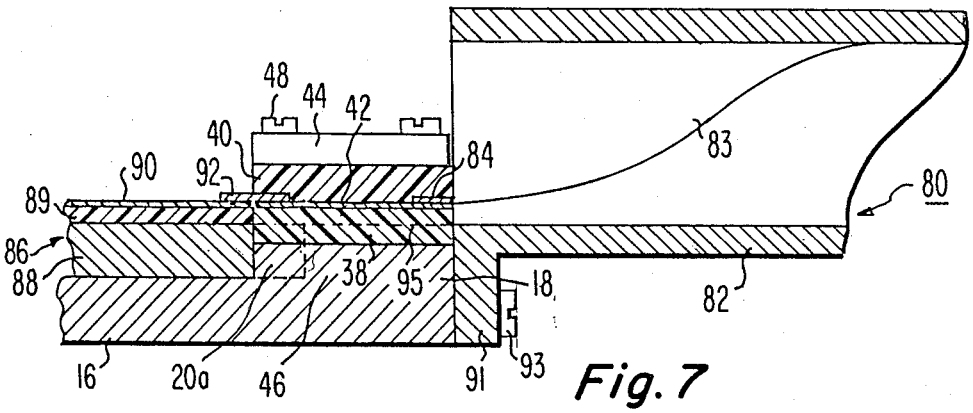
FIG. 7 is a sectional side-elevational view of a microwave assembly embodying still another form of the invention.

The Embodiment of FIG. 7

Still another application that my connecting device is well adapted for is for integrating a waveguide with another microwave component, such as a microstrip circuit. Such an application is illustrated in FIG. 7, where a ridge waveguide is shown at 80. This wave guide comprises a grounded outer hollow housing 82, preferably of rectangular transverse cross-section, and a metal ridge 83 within the housing. The ridge 83 terminates in a thin projecting end portion 84 that extends to the left beyond the left-hand end of the grounded housing structure 82.

The microstrip circuit component that is connected with the waveguide is shown at 86 and comprises a metal carrier 88, a dielectric substrate 89 atop the carrier, and a metallic circuit element 90 bonded to the top surface of the substrate. A thin metal tab 92 is attached by soldering, welding, or conductive adhesive to the circuit element 90 and extends to the right beyond the right-hand end of the substrate 89. The microstrip component is mounted on a floor 16 having an embossment 18 thereon. The waveguide housing 82 has a flange 91 that is clamped to one end of the floor 16 by screws such as 93 that provide a good ground connection between the floor 16 and the waveguide housing 82.

The RF connecting device of FIG. 7 is essentially the same as the RF connecting device 36 of FIGS. 1–3 and is illustrated with its similar parts designated by corresponding reference numerals. In this embodiment, the two housing portions 44 and 46 of the connecting device are clamped together to sandwich the conductive elements 92, 42 and 84 between the two dielectric substrates 38 and 40. At one end of the connecting device, tab 92 of the microstrip circuit is clamped against the central conductor 42, and at the other end of the connecting device, the end portion 84 of the waveguide ridge is clamped against the central conductor 42.

Although not illustrated in detail in FIG. 7, the embodiment of FIG. 7 includes conductive extensions 20*a* on the right-hand end of the carrier 88 (corresponding to the extensions 20*a* of FIGS. 1–3) that are received in recesses (corresponding to recesses 51 of FIGS. 1–3) in the lower housing portion 46. As in FIGS. 1–3, these extensions are clamped between the upper and lower housing portions 44 and 46 by the screws 48 at the left-hand end of the connecting device.

Other Embodiments

It is to be understood that still other types of microwave components, in addition to those illustrated, can readily be interconnected by my connecting device. Some additional examples of such readily interconnectable components are: (1) two coaxial connectors, e.g., of the type shown at 62 in FIGS. 4–6, (2) two circuit components such as 60 in FIGS. 4–6, each having coaxial terminal structures, (3) two stripline circuits, each with projecting tabs, (4) a microstrip circuit, such as 12 in FIGS. 1–3, and a component such as 60 in FIGS. 4–6 having coaxial terminal structure. In each of these applications, the projecting end portion of the circuit component and the central conductor 42 of the connecting device 36 are sandwiched between the dielectric substrates 38 and 40, being clamped together in good contacting relationship.

Before the circuit components are integrated into the final assembly, a prototype assembly of the same configuration as the final assembly can be prepared using these circuit components and a suitable test fixture containing a connecting device of the same configuration as device 36. Suitable performance measurements and adjustments can be made while the components are combined in this prototype assembly. The connecting device of the test fixture is then unclamped, and the circuit components are transferred to the final assembly where the connecting device 36 is utilized. The mechanical clamping utilized in the test fixture leaves the components' leads clean, and reassembly in the final subsystem is extremely simple. Good correlation is obtained between the RF performance of the prototype assembly and that of the final assembly since these two assemblies are of essentially the same configuration, as is the condition of the clamped-together conductive parts.

The components 12, 14, 60 and 86 utilized in the above examples are connectorless components, sometimes referred to as drop-in components. The use of drop-in components and the simplicity and flexibility of my connecting technique enable the volume and cost of the resulting assemblies to be greatly reduced as compared to the volume and cost of assemblies resulting from use of the connector-interconnecting technique described in the introductory portion of this specification.

Additional General Features

Although each of my dielectric segments 38 and 40 is shown and described as being of a single piece, it will be apparent that each of these can be made in multiple pieces. It is sometimes desirable to make the segment 38 of two pieces, the upper one of which is of substantially the same thickness as the substrate of an adjacent microstrip circuit, thus more closely matching the microstrip circuit in form and characteristics and further reducing RF perturbations. In FIG. 7, a dotted line 95 indicates the interface between two such pieces from which dielectric segment 38 can be formed.

The characteristic impedance of the illustrated connecting devices is determined by the dimensions of the channels 45 or 45' that receive the dielectric sections 38, 40 or 38', 40', the dielectric constant of the material of the dielectric sections, and the width and location of the conductive strip 42 or 42'. The relationship between these parameters and the characteristic impedance is known to those skilled in the art. Normally, the characteristic impedance is chosen to match that of the rest of the system containing the connecting device. However, the connecting device can be used in place of an impedance transformer for connecting two devices with different characteristic impedances. In this connection, the characteristic impedance of the connecting device can be varied along the length of the connecting device by varying any of the above-described parameters along such longth.

Although I have shown the dielectric substrates of the various components and the connecting devices being approximately equal in thickness, it is to be understood that in appropriate applications these thicknesses can be substantially different from each other.

Figure 8:
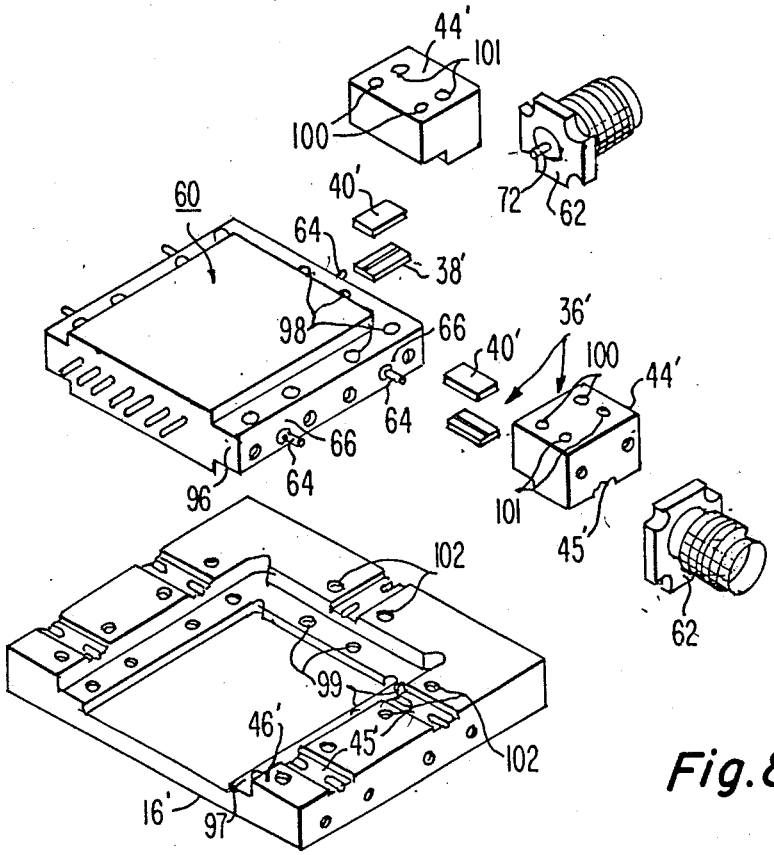
FIG. 8 is an exploded perspective view of a test fixture assembly embodying this invention comprising: (i) a component having coaxial terminal structures, (ii) a pair of coaxial connectors, and (iii) connecting devices for interconnecting the coaxial terminal structures and the connectors.
Figure 9:
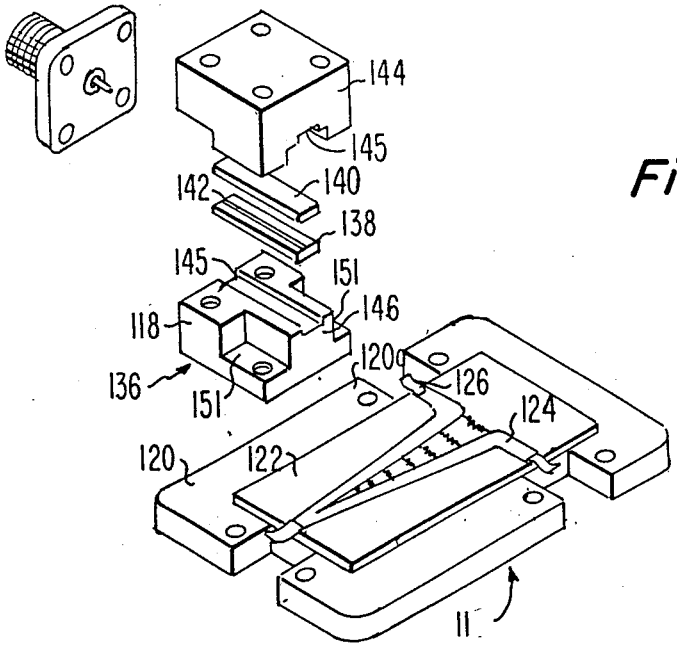
FIG. 9 is an exploded perspective view of a modified form of test fixture assembly.

Test Assemblies of FIGS. 8 and 9

FIG. 8 illustrates how my connecting devices can be used in a test fixture for testing an assembly comprising a relatively large drop-in circuit component (60) and a plurality of coaxial connectors (62). The circuit component 60 has a plurality of conventional coaxial terminal structures 64, 66 corresponding to similarly designated parts in FIGS. 4–6. The dielectric segments of the connecting device 36' are shown at 38' and 40', with dielectric segment 38' having a printed conductor 42' on its upper surface. Segment 38' is received in a channel 45' in the lower housing portion 46', and segment 40' is received in a channel 45' in the upper housing portion 44'. When assembled, the parts are related in essentially the same manner as shown in FIGS. 4–6. The housing 93 of drop-in circuit component 60 has a peripherally projecting rib 96 that fits onto the mating recess shoulder 97 in the floor 16'. Screw holes 98 in the rib 96 are then aligned with the holes 99 in recess shoulder 97 and with similar holes 100 in the upper housing part 44' to receive clamping screws (not shown). Such screws are also applied via aligned holes 101 and 102 in housing part 44' and housing part 46', respectively, to clamp those housing parts directly. Thereby, the ground plane is continuous via the component housing rib 96, the floor 16' and the connector housing 44', 46'.

FIG. 9 illustrates the use of one of my connecting devices (136) for evaluating a microstrip circuit in the form of a power divider 112. This assembly is similar to that of FIGS. 1–3, and corresponding parts of the two assemblies are designated with corresponding reference numerals differing only by the prefix "1". The power divider 112 comprises a metal carrier 120 of plate form, a dielectric substrate 122 bonded to the top surface of the carrier, and printed circuit elements 124 on the top surface of the dielectric substrate. A projecting tab 126 is attached to a circuit element 124 by soldering, welding, or conductive adhesive.

The connecting device 136 of FIG. 9 comprises a lower housing portion 146 and an upper housing portion 144 that are adapted to be clamped together on opposite sides of dielectric sections 138 and 140 respectively received in channels 145 in housing portions 146 and 144. Dielectric section 138 has a printed conductor 142 on its upper surface that tab 126 contacts when the housing portions are clamped together to sandwich the dielectric sections 138 and 140 together on opposite sides of the tab 126 and conductor 142.

In FIG. 9, the carrier 120 has extensions **120*a* that are received in recesses 151 in the lower housing portion 146. These extensions 120*a* are clamped between the upper and lower housing portions 144 and 146** when the connecting device is assembled. This clamping of the housing portions on opposite sides of the carrier extensions provides very good ground continuity in this important region.

In FIG. 9, a coaxial connector 162 is shown as an additional component in the assembly being tested. This coaxial connector 162 corresponds to the connector 62 of FIGS. 4–6 and is integrated into the assembly in the same way as the connector 62 of FIGS. 4–6 is integrated into its assembly.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. In a microwave assembly comprising a pair of microwave components and a stripline type of connecting device for electrically interconnecting said components; each of said microwave components being of one of the following types: (i) a component having a coaxial terminal assembly comprising tubular conductive structure defining a ground plane and a conductor within said tubular conductive structure located substantially coaxially thereof and spaced therefrom and having an end portion projecting beyond one end of the tubular structure, (ii) a circuit component of the microstrip or the stripline type comprising conductive carrier structure defining a ground plane, dielectric substrate on the carrier structure, and a conductor mounted on the substrate and having an end portion projecting beyond one end of the substrate, and (iii) a ridge waveguide comprising hollow conductive structure defining a ground plane, a conductor projecting beyond one end of the tubular structure and including ridge structure within the hollow structure; said stripline connecting device comprising:

(a) elongated interconnecting structure for microwave transmission having conductive terminal portions at opposite ends thereof, said terminal portions having lateral faces respectively contacting but unjoined to the projecting end portions of the conductors of said microwave components, (b) two sections of dielectric material respectively located at laterally-opposed sides of said interconnecting structure, (c) two housing portions of conductive material defining a ground plane for the connecting device, located at laterally-opposed sides of said dielectric sections, and respectively containing channels in which said dielectric sections are respectively located, each of said housing portions comprising a base wall at the base of the channel in said housing portion and sidewalls at opposite sides of said channel, and (d) clamping means comprising spaced-apart fastening devices extending through the sidewalls of at least one of said channels in locations adjacent to but outside said channels for clamping said housing portions together, with said dielectric sections sandwiched between said housing portions and with said conductive terminal portions of said interconnecting structure and the projecting end portions of the conductors of said microwave components sandwiched between said dielectric sections, said projecting end portion extending into said stripline connecting device in overlapping relationship with said housing portions so that clamping forces on said housing portions effectively clamp together the projecting end portions and the conductive terminal portions contacted thereby.

2. The assembly of claim 1 in which:

(a) the sidewalls of each housing portion project from the base wall toward the other housing portion, and (b) said channels are positioned to overlap with each other at said interconnecting structure when the housing portions are clamped together.

3. The assembly of claim 2 in which said channels are positioned in general alignment with each other when the housing portions are clamped together.

4. The assembly of claim 2 in which said sidewalls of each of said housing portions have free ends that engage the free ends of the sidewalls of the other housing portion.

5. The assembly of claim 2 in which the base wall of each of said channels has a recess therein that substantially aligns with the projecting end portion of one of the interconnected components.

6. The assembly of claim 5 in which said recesses are of such shape and size as to render the thickness of the dielectric sections substantially constant across their width along the length of said dielectric sections when the housing portions are fully clamped together.

7. The assembly of claim 2 in which the walls of said channels extend about substantially the entire periphery of the composite dielectric structure comprising the two sections of dielectric material.

8. The assembly of claim 1 in which the dielectric material of said sections is a resilient material that is deformed by said clamping action and said interconnecting structure is free to deform with the dielectric material located therebehind in response to said clamping action.

9. The assembly of claim 1 in which the dielectric material of said sections is a resilient material that is deformed by said clamping action and the terminal portions of said interconnecting structure are of conductive material deposited on one of said dielectric sections.

10. The assembly of claim 1 in which (a) one of said components is a component having a coaxial terminal assembly comprising tubular conductive structure defining a ground plane, (b) one of the housing portions of said connecting device has a portion overlapping said tubular conductive structure of said one component, and (c) said clamping means clamps said overlapping portion to said tubular conductive structure in contacting engagement therewith, thus providing good ground continuity for said assembly in the region where said one component and said connecting device are joined.

11. An assembly constructed as specified in claim 1 in which at least one of said microwave components is of the microstrip type and which assembly further comprises a conductive floor on which the conductive carrier structure of said microstrip type component is mounted, said floor includes as an integral part thereof one of said housing portions of said stripline connecting device.

12. In a microwave assembly comprising a pair of microwave components and a stripline type of connecting device for electrically interconnecting said components; each of said microwave components being of one of the following types: (i) a component having a coaxial terminal assembly comprising tubular conductive structure defining a ground plane and a conductor within said tubular conductive structure located substantially coaxially thereof and spaced therefrom and having an end portion projecting beyond one end of the tubular structure, (ii) a circuit component of the microstrip or the strip-line type comprising conductive carrier structure defining a ground plane, dielectric substrate on the carrier structure, and a conductor mounted on the substrate and having an end portion projecting beyond one end of the substrate, and (iii) a ridge waveguide comprising hollow conductive structure defining a ground plane, a conductor projecting beyond one end of the tubular structure and including ridge structure within the hollow structure; said stripline connecting device comprising:

(a) elongated interconnecting structure for microwave transmission having conductive terminal portions at opposite ends thereof, said terminal portions having lateral faces respectively contacting but unjoined to the projecting end portions of the conductors of said microwave components, (b) two sections of dielectric material respectively located at laterally-opposed sides of said interconnecting structure, (c) two housing portions of conductive material defining a ground plane for the connecting device, located at laterally-opposed sides of said dielectric sections, and respectively containing channels in which said dielectric sections are respectively located, (d) clamping means for clamping said housing portions together, with said dielectric sections sandwiched between said housing portions and with said conductive terminal portions of said interconnecting structure and the projecting end portions of the conductors of said microwave components sandwiched between said dielectric sections, said projecting end portions extending into said stripline connecting device in overlapping relationship with said housing portions so that clamping forces on said housing portions effectively clamp together the projecting end portions and the conductive terminal portions contacted thereby, and in which:

one of said components is of the microstrip type, and the conductive carrier structure thereof has projecting portions extending into positions between said two housing portions, and said clamping means clamps said projecting portions between said two housing portions, thus, providing good ground continuity for said assembly in the region where said one component and said connecting device are joined.

13. In a microwave assembly comprising: (i) a pair of microwave components, at least one of which is of the microstrip type and comprises conductive carrier structure defining a ground plane, dielectric substrate on the carrier structure, and a conductor mounted on the substrate and having an end portion projecting beyond one end of the substrate, and (ii) a stripline connecting device for electrically interconnecting said components; the other of said microwave components comprising conductive structure defining a ground plane, a conductor located adjacent said conductive structure, and dielectric means between said latter conductor and said conductive structure, the latter conductor having a projecting end portion; said stripline connecting device comprising:

(a) elongated interconnecting structure for microwave transmission having conductive terminal portions at opposite ends thereof, said terminal portions having lateral faces respectively contacting but unjoined to the projecting end portions of the conductors of said microwave components, (b) two sections of dielectric material respectively located at laterally-opposed sides of said interconnecting structure, (c) two housing portions of conductive material defining a ground plane for the connecting device and located at laterally-opposed sides of said dielectric sections, and (d) clamping means for clamping said housing portions together, with said dielectric sections sandwiched between said housing portions and with said conductive terminal portions of said interconnecting structure and the projecting end portions of the conductors of said microwave components sandwiched between said dielectric sections, said projecting end portions extending into said stripline connecting device in overlapping relationship with said housing portions so that clamping forces on said housing portions effectively clamp together the projecting end portions and the conductive terminal portions contacted thereby, and in which said microwave assembly further comprises a conductive floor on which the conductive carrier structure of said microstrip type component is mounted, and said floor includes as an integral part thereof one of said housing portions of said stripline connecting device.

14. The assembly of claim 13 in which each of said housing portions has a channel in which the dielectric section at one side of said interconnecting structure is located.

15. The assembly of claim 14 in which:

(a) the conductive carrier structure of said microstrip type component has projecting portions extending into positions between said two housing portions, and (b) said clamping means clamps said projecting portions between said two housing portions, thus providing good ground continuity for said assembly in the region where said one component and said connecting device are joined.

16. The assembly of claim 14 in which:

(a) each of said housing portions comprises a base wall at the base of the channel in said housing portion and sidewalls at opposite sides of said channel, the sidewalls of each housing portion projecting from the base wall toward the other housing portion, and (b) said channels are positioned to overlap with each other at said interconnecting structures when the housing portions are clamped together.

17. The assembly of claim 16 in which said channels are positioned in general alignment with each other when the housing portions are clamped together.

18. The assembly of claim 16 in which said sidewalls of each of said housing portions have free ends that engage the free ends of the sidewalls of the other housing portion.

19. The assembly of claim 16 in which the base wall of each of said channels has a recess therein that substantially aligns with the projecting end portion of one of the interconnected components.

20. The assembly of claim 19 in which said recesses are of such shape and size as to render the thickness of the dielectric sections substantially constant across their width along the length of said dielectric sections when the housing portions are fully clamped together.

21. The assembly of claim 15 in which the walls of said channels extend about substantially the entire periphery of the composite dielectric structure comprising the two sections of dielectric material.

22. The assembly of claim 13 in which the dielectric material of said sections is a resilient material that is deformed by said clamping action and said interconnecting structure is free to deform with the dielectric material located therebehind in response to said clamping action.

23. The assembly of claim 13 in which the dielectric material of said sections is a resilient material that is deformed by said clamping action and the terminal portions of said interconnecting structure are of conductive material deposited on one of said dielectric sections.

24. The assembly of claim 16 in which the means for clamping said housing portions together comprises spaced-apart fastening devices extending through said sidewalls.

25. The assembly of claim 13 in which:

(a) one of said components is a component having a coaxial terminal assembly comprising tubular conductive structure defining a ground plane, (b) one of the housing portions of said connecting device has a portion overlapping said tubular conductive structure of said one component, and (c) said clamping means clamps said overlapping portion to said tubular conductive structure in contacting engagement therewith, thus providing good ground continuity for said assembly in the region where said one component and said connecting device are joined.

26. A fixture for: (i) receiving a drop-in microwave circuit component having a periphery and at spaced locations about said periphery a plurality of coaxial terminal assemblies, each comprising tubular conductive structure defining a ground plane and a conductor within said tubular conductive structure located substantially coaxially thereof and spaced therefrom and having an end portion projecting beyond one end of the tubular structure, and (ii) making electrical connection between said conductors and the conductors of a plurality of coaxial connectors, each of said conductors having a projecting end portion, said fixture including a plurality of stripline connecting devices each comprising:

(a) elongated interconnecting structure for microwave transmission having conductive terminal portions at opposite ends thereof, said terminal portions having lateral faces respectively contacting but unjoined to said projecting end portions of the conductors of a coaxial terminal assembly and a mating coaxial connector, (b) two sections of dielectric material respectively located at laterally-opposed sides of said interconnecting structure, (c) two housing portions of conductive material defining a ground plane for the connecting device, located at laterally-opposed sides of said dielectric sections, and respectively containing channels in which said dielectric sections are respectively located, and (d) clamping means for clamping said housing portions together, with said dielectric sections sandwiched between said housing portions and with said conductive terminal portions of said interconnecting structure and the projecting end portions of the conductors of said microwave components sandwiched between said dielectric sections, said projecting end portions extending into said stripline connecting device in overlapping relationship with said housing portions so that clamping forces on said housing portions effectively clamp together the projecting end portions and the conductive terminal portions contacted thereby, and in which said fixture further comprises a conductive floor which has a portion extending adjacent said periphery of said drop-in microwave circuit component, said floor portion including as integral parts thereof one of the housing portions of each of said stripline connecting devices.

* * * * *